US005798686A

United States Patent [19]

Schreiner

[11] Patent Number: 5,798,686

[45] Date of Patent: Aug. 25, 1998

[54] VOICE EMITTING PIN

[76] Inventor: Stefan C. Schreiner, 21570 Edge Cliff Dr., Euclid, Ohio 44123

[21] Appl. No.: 877,712

[22] Filed: Jun. 18, 1997

[51] Int. Cl.[6] ..... G08B 3/10

[52] U.S. Cl. ..... 340/384.7; 340/692; 340/573; 340/321; 369/63; 446/404; 446/270; 2/1

[58] Field of Search ..... 340/384.7, 692, 340/573, 321, 384.6; 369/63, 64; 381/61; 446/175, 404, 270, 297, 397

[56] References Cited

U.S. PATENT DOCUMENTS 4,158,197 6/1979 Takagaki ..... 340/574
5,463,369 10/1995 Lamping ..... 340/384.7
5,487,925 1/1996 Simmel et al. ..... 428/19
5,635,898 6/1997 Walters et al. ..... 340/384.7

*Primary Examiner*—Donnie L. Crosland

[57] ABSTRACT

A voice emitting pin is provided including a housing with a back opening and an interior space. Further provided is a back cover for releasably engaging the back opening of the housing. Also included is a pin assembly coupled to a rear surface of the back cover with an associated pin, whereby the pin may be releasably coupled to a shirt of a user. A triangular ornament is coupled to the housing. A watch battery is situated within the interior space of the housing. Finally, a voice chip is situated within the interior space of the housing and connected to the battery for powering purposes. The voice chip has a switch for effecting transmission of an audible voice remark upon the depression thereof.

7 Claims, 3 Drawing Sheets

VOICE EMITTING PIN

BACKGROUND OF THE INVENTION

1. Field of the Invention

The present invention relates to a voice emitting pin and more particularly pertains to emitting an audible remark upon depression of an associated button.

2. Description of the Prior Art

The use of ornamental pins is known in the prior art. More specifically, ornamental pins heretofore devised and utilized for ornamental purposes are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. Nos. 4,158,197; 5,276,434; U.S. Pat. Des. No. 261,872; U.S. Pat. Nos. 4,668,940; 5,082,630; and 5,218,347.

In this respect, the voice emitting pin according to the present invention substantially departs from the conventional concepts and designs of the prior art, and in so doing provides an apparatus primarily developed for the purpose of emitting an audible remark upon depression of an associated button.

Therefore, it can be appreciated that there exists a continuing need for a new and improved voice emitting pin which can be used for emitting a audible remark upon depression of an associated button. In this regard, the present invention substantially fulfills this need.

SUMMARY OF THE INVENTION

In view of the foregoing disadvantages inherent in the known types of ornamental pins now present in the prior art, the present invention provides an improved voice emitting pin. As such, the general purpose of the present invention, which will be described subsequently in greater detail, is to provide a new and improved voice emitting pin which has all the advantages of the prior art and none of the disadvantages.

To attain this, the present invention essentially comprises a central housing having a disk-shaped configuration with a circular front face and a cylindrical periphery integrally coupled thereto. Such periphery extends rearwardly therefrom thereby defining a back opening and an interior space, as shown in FIG. 3. The periphery has a lip extending rearwardly past the back opening with threaded grooves formed on an interior peripheral surface thereof. The central housing further has a generally disk-shaped compartment positioned within the interior space adjacent the front face thereof. Next provided is a back cover including a circular plate having an outer periphery with threaded grooves formed therein. Such threaded grooves are adapted for releasably engaging the threaded grooves of the central housing. Also included is a pin assembly with a pin having a first end and a second end. The first end of the pin is hingably coupled to a rear surface of the back cover and the second end is free with a point formed thereon. The pin assembly further includes a hook coupled to the rear face of the back cover for releasably receiving the second end of the pin, whereby the pin may be releasably coupled to a shirt of a user. As best shown in FIGS. 1 & 4, a triangular ornament is provided having a vertically oriented oval cut out formed therein between a bottom and a central extent thereof. The central housing is coupled to the central extent of the triangular ornament such that the central housing and triangular ornament reside in essentially the same plane. Situated within the interior space of the central housing and adjacent the back opening thereof is a watch battery. Finally, a voice chip is situated within the interior space of the central housing adjacent the compartment thereof. The voice chip is connected to the battery for powering purposes. The voice chip has a front face with a first contact in the form of a conductive post extending outwardly therefrom into the compartment of the central housing. Associated therewith is a second contact in the form of a conductive L-shaped arm. Such arm has a first extent coupled to the front face and a second extent situated over the first contact and spaced therefrom. By this structure, upon the depression of the front face of the central housing, the second contact is biased to contact the first contact thereby effecting transmission of an audible voice remark.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved voice emitting pin which has all the advantages of the prior art ornamental pins and none of the disadvantages.

It is another object of the present invention to provide a new and improved voice emitting pin which may be easily and efficiently manufactured and marketed.

It is a further object of the present invention to provide a new and improved voice emitting pin which is of a durable and reliable construction.

An even further object of the present invention is to provide a new and improved voice emitting pin which is susceptible of a low cost of manufacture with regard to both materials and labor, and which accordingly is then susceptible of low prices of sale to the consuming public, thereby making such voice emitting pin economically available to the buying public.

Still yet another object of the present invention is to provide a new and improved voice emitting pin which provides in the apparatuses and methods of the prior art some of the advantages thereof, while simultaneously overcoming some of the disadvantages normally associated therewith.

Still another object of the present invention is to emit an audible remark upon depression of an associated button.

Lastly, it is an object of the present invention to provide a new and improved voice emitting pin including a housing with a back opening and an interior space. Further provided is a back cover for releasably engaging the back opening of the housing. Also included is a pin assembly coupled to a rear surface of the back cover with an associated pin, whereby the pin may be releasably coupled to a shirt of a user. A triangular ornament is coupled to the housing. A watch battery is situated within the interior space of the housing. Finally, a voice chip is situated within the interior space of the housing and connected to the battery for powering purposes. The voice chip has a switch for effecting transmission of an audible voice remark upon the depression thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
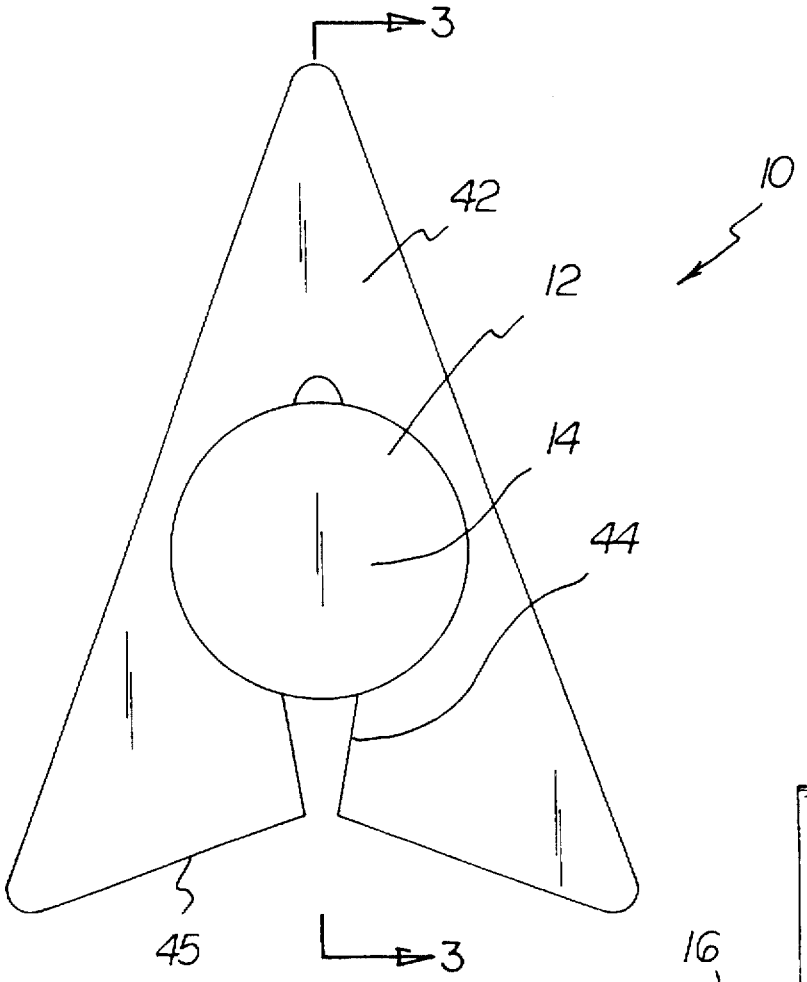
FIG. 1 is a perspective illustration of the preferred embodiment of the voice emitting pin constructed in accordance with the principles of the present invention.
Figure 2:
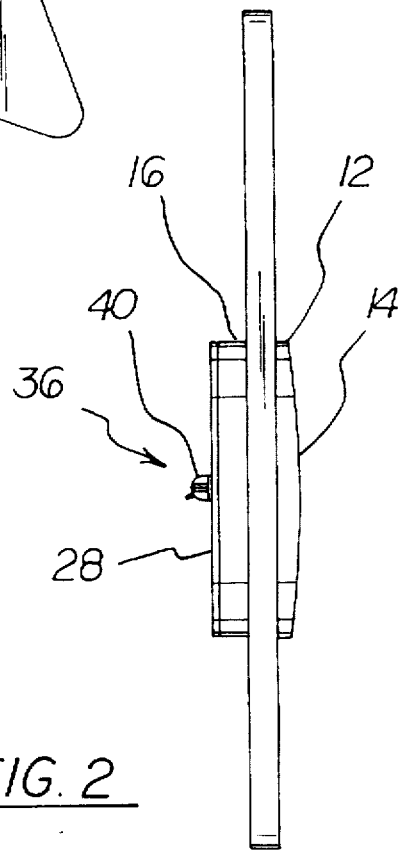
FIG. 2 is a side view of the central housing and triangular ornament of the present invention.

With reference now to the drawings, and in particular to FIG. 1 thereof, a new and improved voice emitting pin embodying the principles and concepts of the present invention and generally designated by the reference numeral 10 will be described.

The present invention, the new and improved voice emitting pin, is comprised of a plurality of components. Such components in their broadest context include a central housing, back cover, pin assembly, triangular ornament, battery, and voice chip. Such components are individually configured and correlated with respect to each other so as to attain the desired objective.

Figure 3:
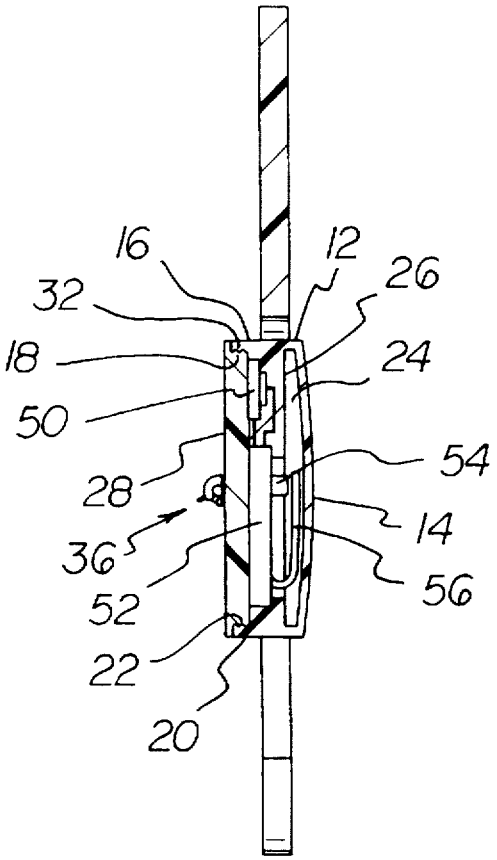
FIG. 3 is a cross-sectional view of the central housing and the various components situated therein.

More specifically, it will be noted that the system 10 of the present invention includes a central housing 12 having a disk-shaped configuration with a circular front face 14 and a cylindrical periphery 16 integrally coupled thereto. Such periphery extends rearwardly therefrom thereby defining a back opening 18 and an interior space, as shown in FIG. 3. The periphery has a lip 20 extending rearwardly past the back opening with threaded grooves 22 formed on an interior peripheral surface thereof. The central housing further has a generally disk-shaped compartment 24 positioned within the interior space 26 adjacent the front face thereof. Preferably, the front face is bowed slightly outwards in an unbiased orientation. For reasons that will become apparent later, the front face is thin and formed of an elastomeric material.

Next provided is a back cover 28 including a circular plate having an outer periphery with threaded grooves 32 formed therein. Such threaded grooves are adapted for releasably engaging the threaded grooves of the central housing.

Also included is a pin assembly 36 with a pin 38 having a first end and a second end. The first end of the pin is hingably coupled to a rear surface of the back cover and the second end is free with a point formed thereon. The pin assembly further includes a hook 40 coupled to the rear face of the back cover for releasably receiving the second end of the pin, whereby the pin may be releasably coupled to a shirt of a user. Associated with the hook is a latch member 41 adapted to transform the hook into a closed loop such that the second end of the pin may not be removed.

Figure 4:
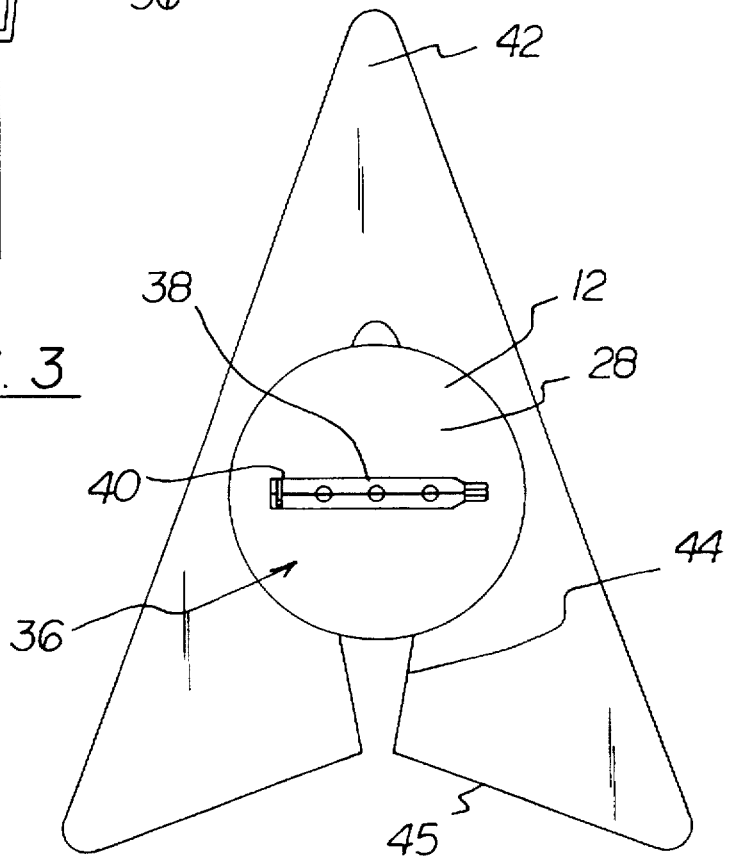
FIG. 4 is a rear view of the present invention.
Figure 5:
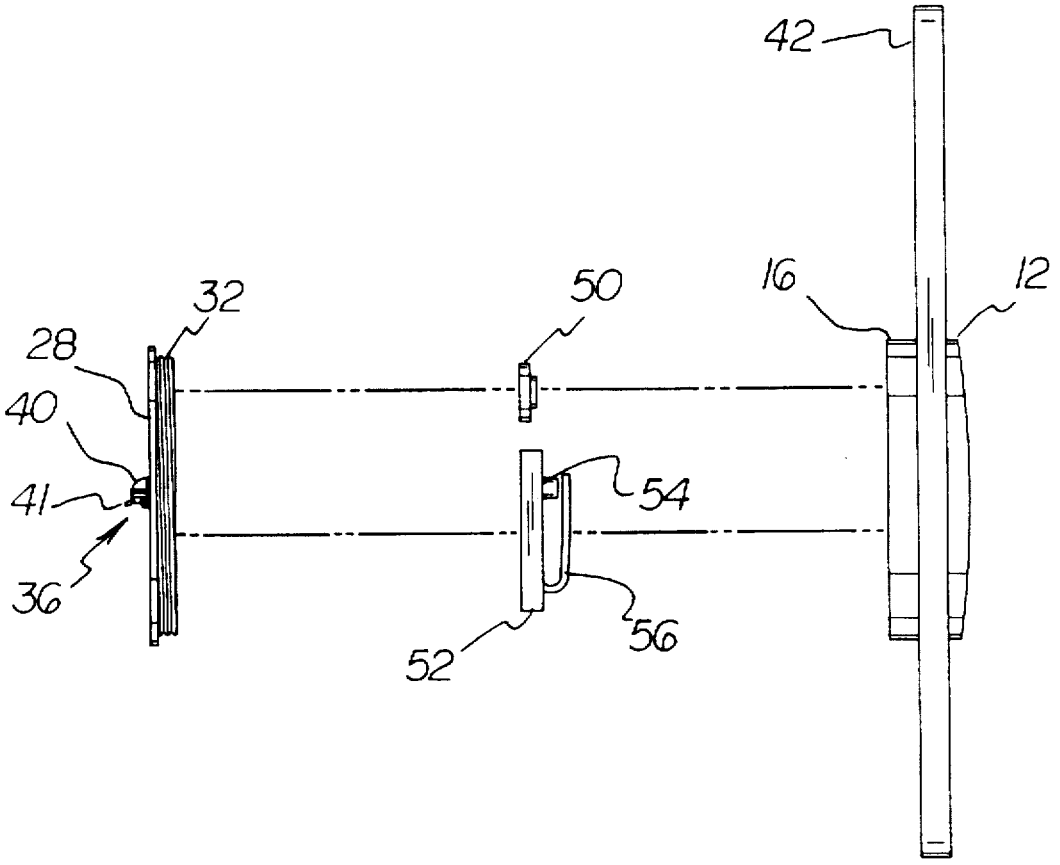
FIG. 5 is an exploded view of the present invention.
Figure 6:
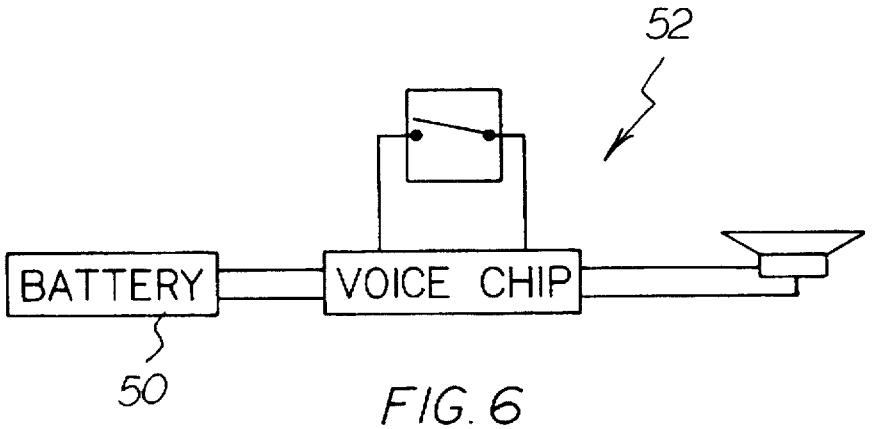
FIG. 6 is a schematic diagram depicting the various electrical components of the present invention.

As best shown in FIGS. 1 & 4, a triangular ornament 42 is provided having a vertically oriented oval cut out 44 formed therein between a bottom and a central extent thereof. The central housing is coupled to the central extent of the triangular ornament such that the central housing and triangular ornament reside in essentially the same plane. As shown in FIG. 4, the bottom of the triangular component has a triangular cut out 45 formed therein. Such ornament is also equipped with a circular cut out with an inner periphery that the triangular ornament is adhered.

Situated within the interior space of the central housing and adjacent the back opening thereof is a watch battery 50.

Finally, a voice chip 52 is situated within the interior space of the central housing adjacent the compartment thereof. The voice chip is connected to the battery for powering purposes. Such connection is accomplished by way of a pair of wires. The voice chip has a front face with a first contact 54 in the form of a conductive post extending outwardly therefrom into the compartment of the central housing. Associated therewith is a second contact 56 in the form of a conductive L-shaped arm. Such arm has a first extent coupled to the front face of the voice chip and a second extent situated over the first contact and spaced therefrom. By this structure, upon the depression of the front face of the central housing, the second contact is biased to contact the first contact thereby effecting transmission of an audible voice remark. Such vocal remark preferably consists of "WARNING, WARNING, WARNING, AIR LEVELS ARE UNSAFE." It should be noted that voice chips capable of reciting a phrase such as this are commercially available and commonly known in the art of toys and the like.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved voice emitting pin comprising, in combination:

a central housing having a disk-shaped configuration with a circular front face and a cylindrical periphery integrally coupled thereto and extending rearwardly therefrom thereby defining a back opening and an interior space, the periphery having a lip extending rearwardly past the back opening with threaded grooves formed on an interior peripheral surface thereof, the central housing further having a disk-shaped compartment positioned within the interior space adjacent the front face thereof;

a back cover including a circular plate having an outer periphery with threaded grooves formed therein for releasably engaging the threaded grooves of the central housing;

a pin assembly including a pin having a first end hingably coupled to a rear surface of the back cover and a free sharp second end, the pin assembly further including a hook coupled to the rear face of the back cover for releasably receiving the second end of the pin whereby the pin may be releasably coupled to a shirt of a user;

a triangular ornament having a vertically oriented oval cut out formed therein between a bottom and a central extent thereof, wherein the central housing is coupled to the central extent of the triangular ornament such that the central housing and triangular ornament reside in essentially the same plane;

a watch battery situated within the interior space of the central housing adjacent the back opening thereof;

a voice chip situated within the interior space of the central housing adjacent the compartment thereof and connected to the battery for powering purposes, the voice chip having a front face with a first contact in the form of a conductive post extending outwardly therefrom into the compartment of the central housing and a second contact in the form of a conductive L-shaped arm with a first extent coupled to the front face and a second extent situated over the first contact and spaced therefrom, whereby upon the depression of the front face of the central housing, the second contact is biased to contact the first contact thereby effecting transmission of an audible voice remark.

2. A voice emitting pin comprising:

a housing with a back opening and an interior space;

a back cover for releasably engaging the back opening of the housing;

a pin assembly coupled to a rear surface of the back cover with an associated pin, whereby the pin may be releasably coupled to a shirt of a user;

a triangular ornament coupled to the housing;

a watch battery situated within the interior space of the housing;

a voice chip situated within the interior space of the housing and connected to the battery for powering purposes, the voice chip having a switch for effecting transmission of an audible voice remark upon the depression thereof.

3. A voice emitting pin as set forth in claim 2 the housing further has a disk-shaped compartment positioned within the interior space adjacent a front face thereof, wherein the switch is situated adjacent the compartment.

4. A voice emitting pin as set forth in claim 3 wherein the switch includes a first contact in the form of a conductive post extending outwardly therefrom into the compartment of the housing and a second contact in the form of a conductive L-shaped arm with a first extent coupled to a front face of the voice chip and a second extent situated over the first contact and spaced therefrom, whereby upon the depression of the front face of the central housing, the second contact is biased to contact the first contact, thereby effecting transmission of the audible voice remark upon the depression thereof.

5. A voice emitting pin as set forth in claim 2 wherein the triangular ornament has a vertically oriented oval cut out formed therein between a bottom and a central extent thereof.

6. A voice emitting pin as set forth in claim 2 wherein the back cover is screwably coupled to the housing.

7. A voice emitting pin as set forth in claim 2 wherein the pin assembly includes a pin having a first end hingably coupled to the back cover and a free sharp second end, the pin assembly further including a hook coupled to the rear face of the back cover.

* * * * *